US007040585B2

(12) United States Patent
Cheng et al.

(10) Patent No.: US 7,040,585 B2
(45) Date of Patent: May 9, 2006

(54) TOYS BRACING BRACKET

(75) Inventors: Huang-Yi Cheng, Chia-I Hsien (TW); Ming-Chi Tsai, Yunlin Hsien (TW); Ho-Sheng Chen, Chia-I Hsien (TW)

(73) Assignee: Link Treasure Limited, Tortola (VG)

( * ) Notice: Subject to any disclaimer, the term of this patent is extended or adjusted under 35 U.S.C. 154(b) by 6 days.

(21) Appl. No.: 10/824,351

(22) Filed: Apr. 15, 2004

(65) Prior Publication Data

US 2004/0206866 A1 Oct. 21, 2004

(51) Int. Cl.
*F16M 11/00* (2006.01)

(52) U.S. Cl. ..... 248/200; 248/205.1; 248/220.21; 135/125; 135/135; 5/97

(58) Field of Classification Search ..... 248/200, 248/205.1, 220.21, 220.22, 222.51, 345, 248/52, 230.7, 230.6, 231.71, 227.4; 135/123, 135/125, 87, 30, 102, 104, 90–98; 256/25; 5/99.1, 97

See application file for complete search history.

(56) References Cited

U.S. PATENT DOCUMENTS

| | | | | |
|---|---|---|---|---|
| 4,750,509 | A | 6/1988 | Kim | 135/102 |
| 5,195,551 | A * | 3/1993 | Ju | 135/126 |
| 5,517,707 | A * | 5/1996 | LaMantia | 5/97 |
| 6,467,107 | B1 * | 10/2002 | Glover et al. | 5/99.1 |

* cited by examiner

*Primary Examiner*—Robert P. Olszewski
*Assistant Examiner*—Todd M. Epps

(74) *Attorney, Agent, or Firm*—Birch, Stewart, Kolasch & Birch, LLP

(57) ABSTRACT

A toys bracing bracket for mounting on a playpen or a play pad is detachable. It mainly includes a central pivot dock that has a first anchor section and a second anchor section to couple with a plurality of connection rods. Each of the connection rods is coupled with an elastic element so that the connection rods may be easily pulled and extended for mounting on the playpen or play pad, or be folded easily to facilitate carrying and storing, and to enhance safety.

14 Claims, 7 Drawing Sheets

TOYS BRACING BRACKET

This Non-provisional application claims priority under 35 U.S.C. § 119(a) on patent application Ser. No(s). 092206025 filed in Taiwan on Apr. 16, 2003, the entire contents of which are hereby incorporated by reference.

FIELD OF THE INVENTION

The present invention relates to a toys bracing bracket that has a central pivot dock, housing a first anchor seat and a second anchor seat to couple with a plurality of connection rods. Each rod is coupled with an elastic element, such, that the connection rods are pullable, to extend easily for mounting on a playpen or a play pad and folding easily to facilitate carrying and storing.

BACKGROUND OF THE INVENTION

Playpen is usually used to confine a small child within a safety area without exposing to risks before he/she can walk when adults are not able to take care of the child constantly. The adults generally will provide toys in the playpen or hang toys on a toy bracket to amuse the child. For instance, U.S. Pat. No. 4,750,509 discloses a folding device of a tent-frame work that includes a central hub member and a plurality of ribs. The ribs are connected radial to the central hub member when in use. It takes a lot of time to set up.

SUMMARY OF THE INVENTION

The primary object of the invention is to overcome the disadvantages of a tedious assembly task occurring to the conventional toys bracing bracket mounted on the playpen or play pad. The present invention provides a toy bracing bracket that is mounted astride the playpen or play pad. The toys bracing bracket is extended and folded easily. It mainly includes a central pivot dock that has a plurality of pivotal coupling troughs. Each of the pivotal coupling troughs has a first anchor section and a second anchor section. Each pivotal coupling trough is coupled with a connection rod. The connection rod has one end engaged with the playpen and another end pivotally coupled on the pivotal coupling trough that may be moved to the first anchor section for extension and the second anchor section for folding. The user can easily switch the extension and folding of the connection rods and the toybracing bracket.

The foregoing, as well as additional objects, features and advantages of the invention will be more readily apparent from the following detailed description, which proceeds with reference to the accompanying drawings. The description and drawings are to serve for reference and illustrative purpose only, and shall not be considered as a limitation of the invention.

The present invention will become more fully understood from the detailed description given hereinbelow and the accompanying drawings which are given by way of illustration only, and thus are not limitative of the present invention, and wherein:

DESCRIPTION OF THE PREFERRED EMBODIMENTS

Figure 1:
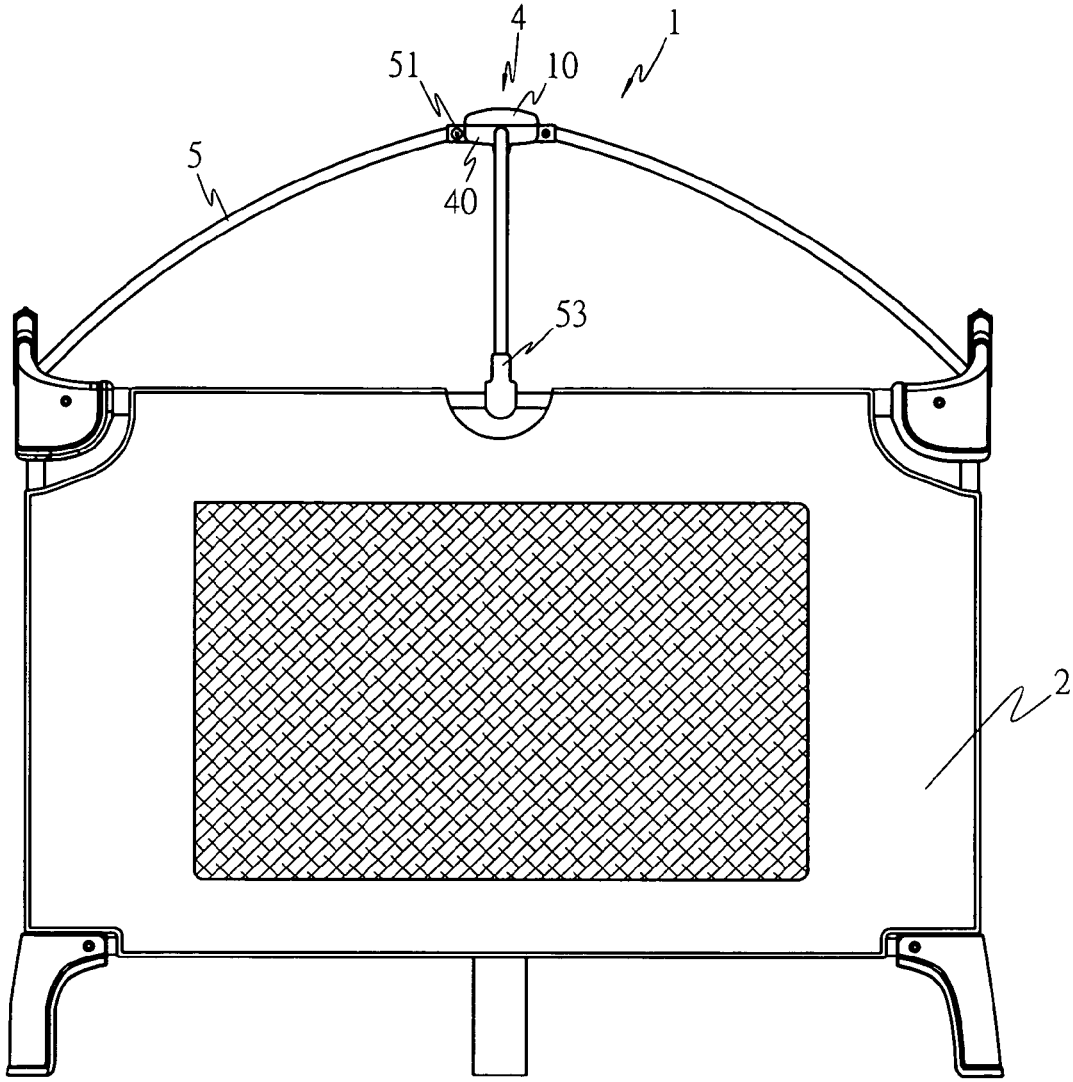
FIG. 1 is a schematic view of the invention mounted on a playpen.
Figure 2:
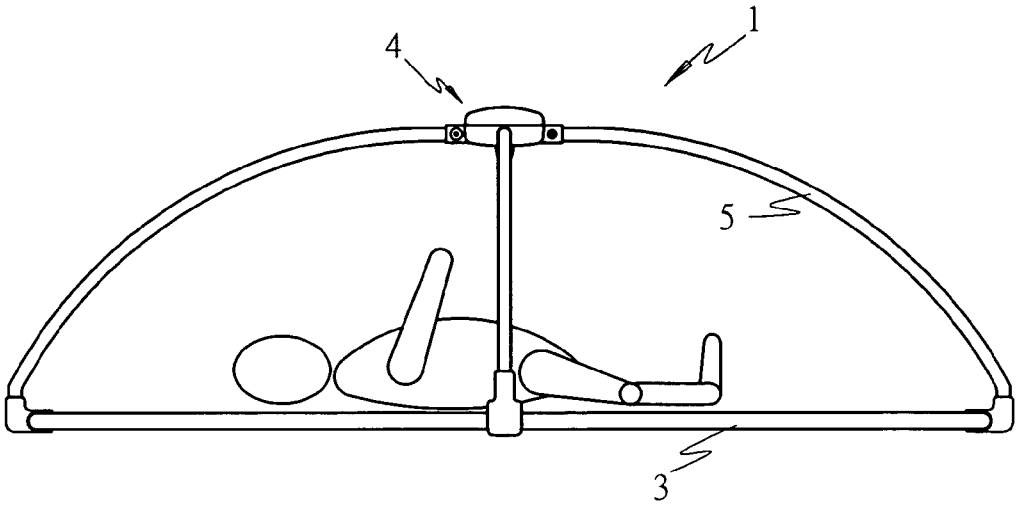
FIG. 2 is a schematic view of the invention mounted on a play pad.
Figure 3:
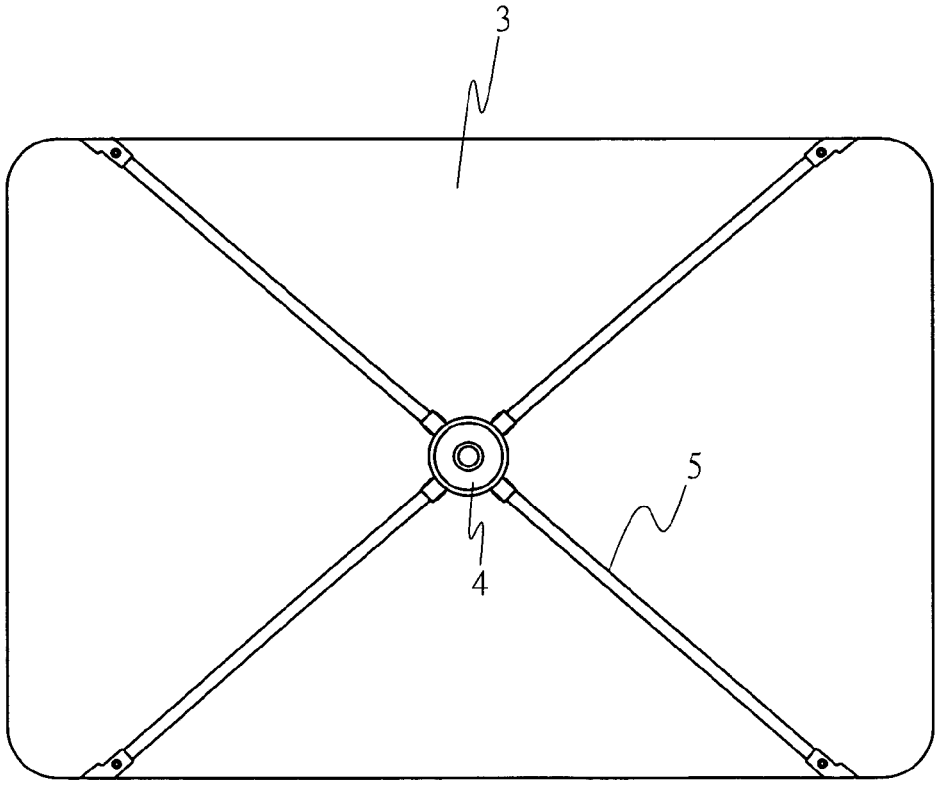
FIG. 3 is a schematic top view of the invention.
Figure 4:
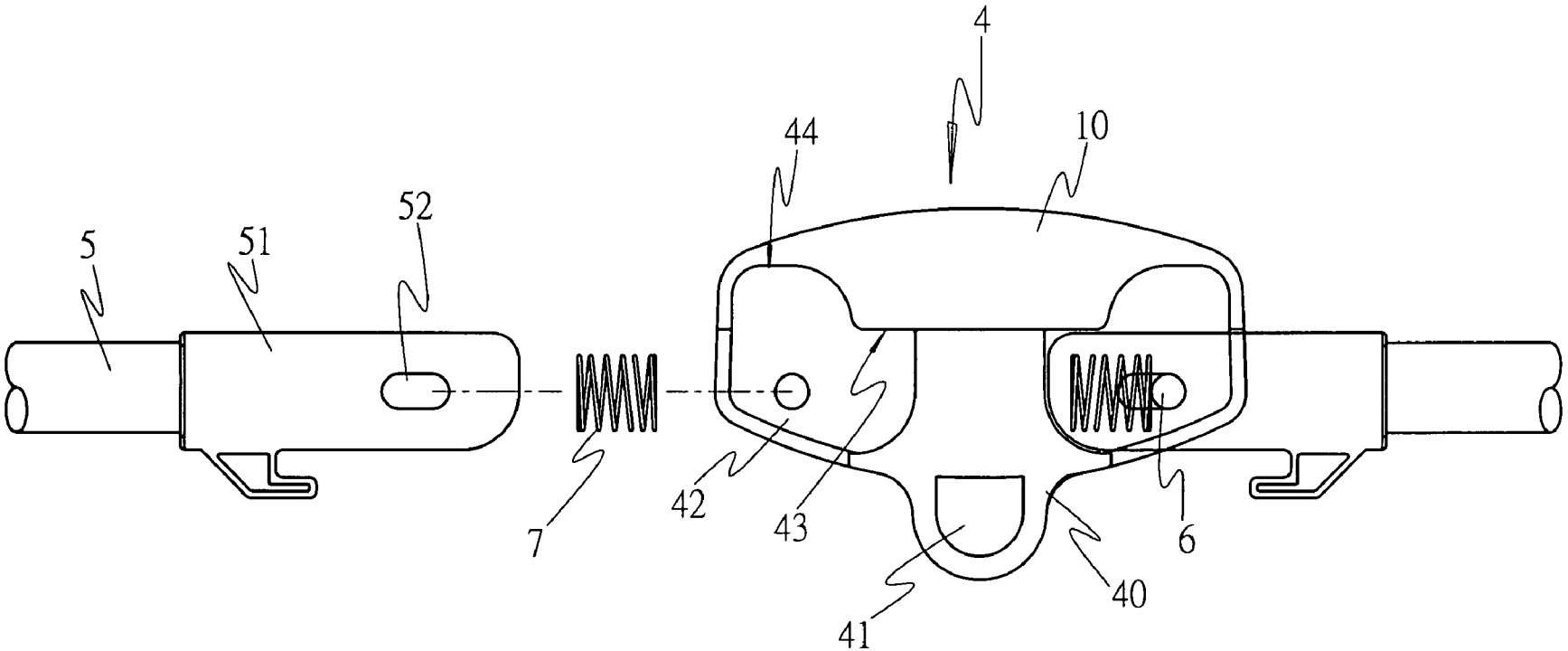
FIG. 4 is a fragmentary exploded and sectional view of the invention.
Figure 5:
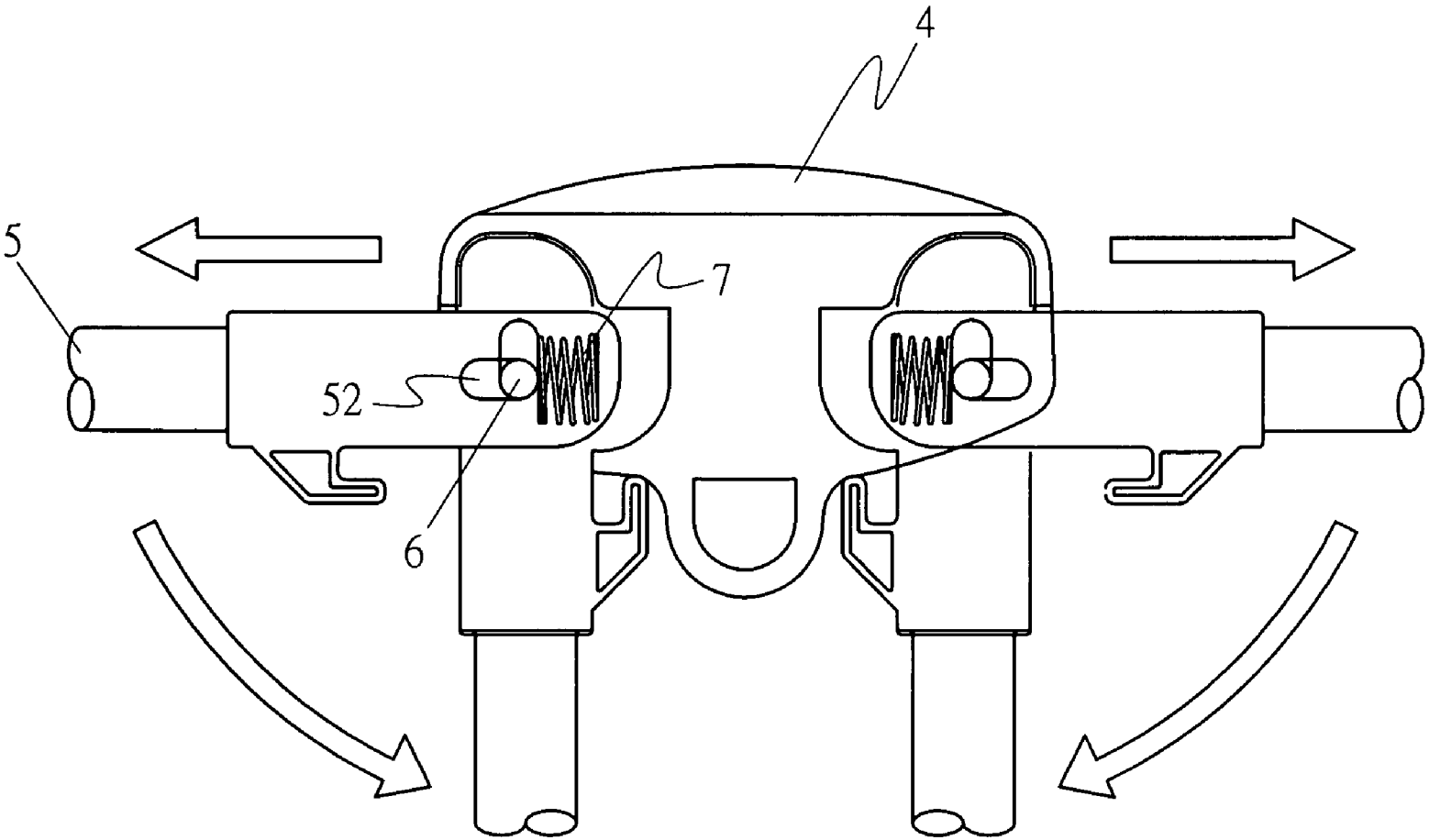
FIG. 5 is a schematic view of the invention with the connection rod in an operating condition.

Referring to FIGS. 1, 2 and 3, the toys bracing bracket 1 of the present invention mainly aims to be mounted astride on a playpen 2 or a play pad 3. It includes (also referring to FIGS. 4 and 5):

A central pivot dock 4, which is a shell consisting of an upper cap 10 and a lower cap 40. The lower cap 40 has a hanging section 41 at a lower side for hanging toys. The shell includes at least a plurality of pivotal coupling troughs 42 that are formed radially. Each of the pivotal coupling troughs 42 has a first anchor section 43 and a second anchor section 44 that are normal to each other; and A plurality of connection rods 5 is made from flexible hollow tubes. Each of the connection rods 5 has one end forming a pivotal coupling section, 51 which has a transverse slot 52 to be coupled with the pivotal coupling trough 42 through an axle 6 and is compressed by an elastic element 7 (in this embodiment, the elastic element is a compression spring), which is located between the pivotal coupling section 51 and the central pivot dock 4. The elastic element 7 can keep the connection rod 5 latching on the first anchor section 43 (extended condition). By pulling the connection rod 5 to compress the elastic element 7, the connection rod 5 may be turned and moved to the second anchor section 44 (folding condition).

Figure 6:
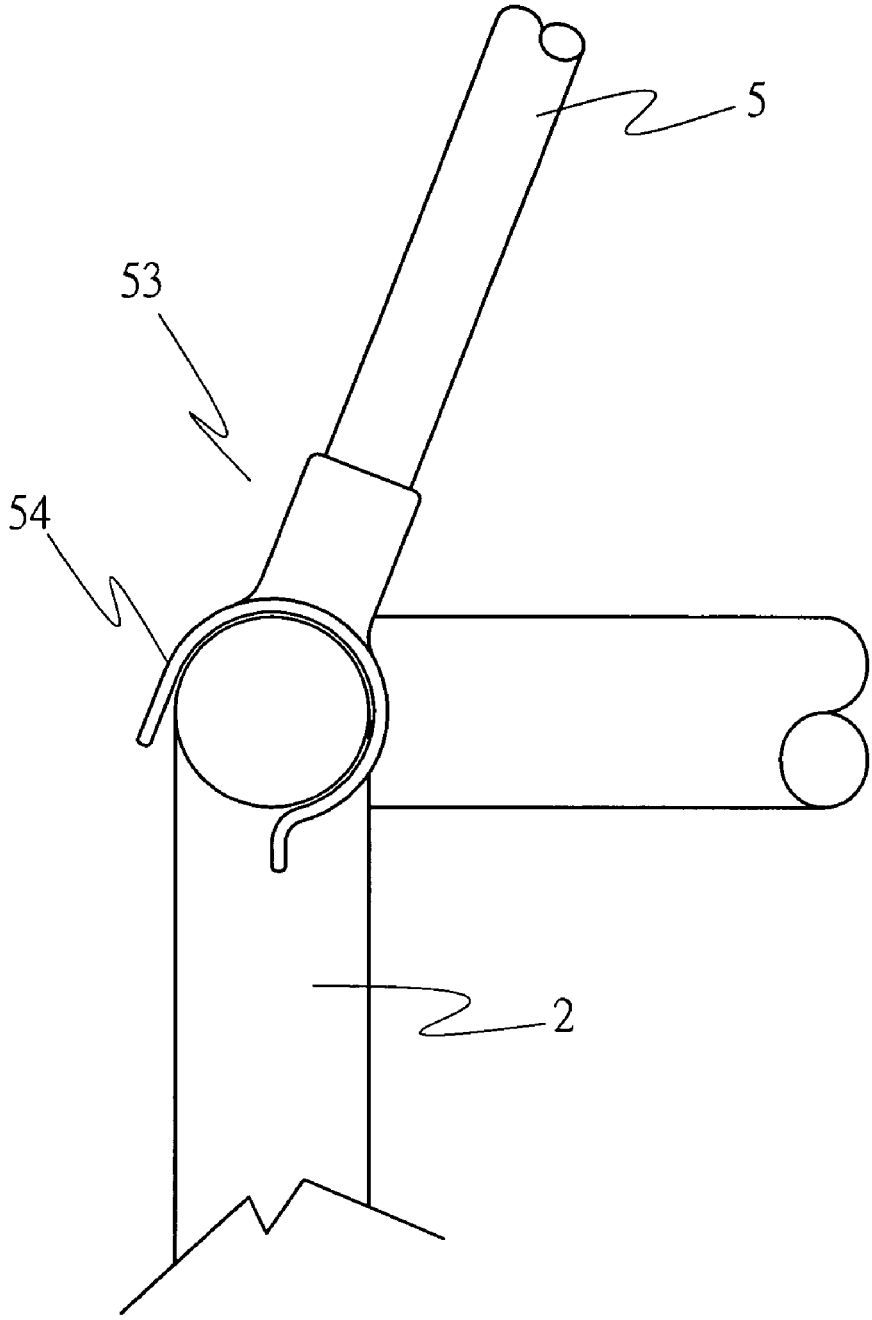
FIG. 6 is a schematic view of an embodiment of the connection section of the invention, being a clip.
Figure 7:
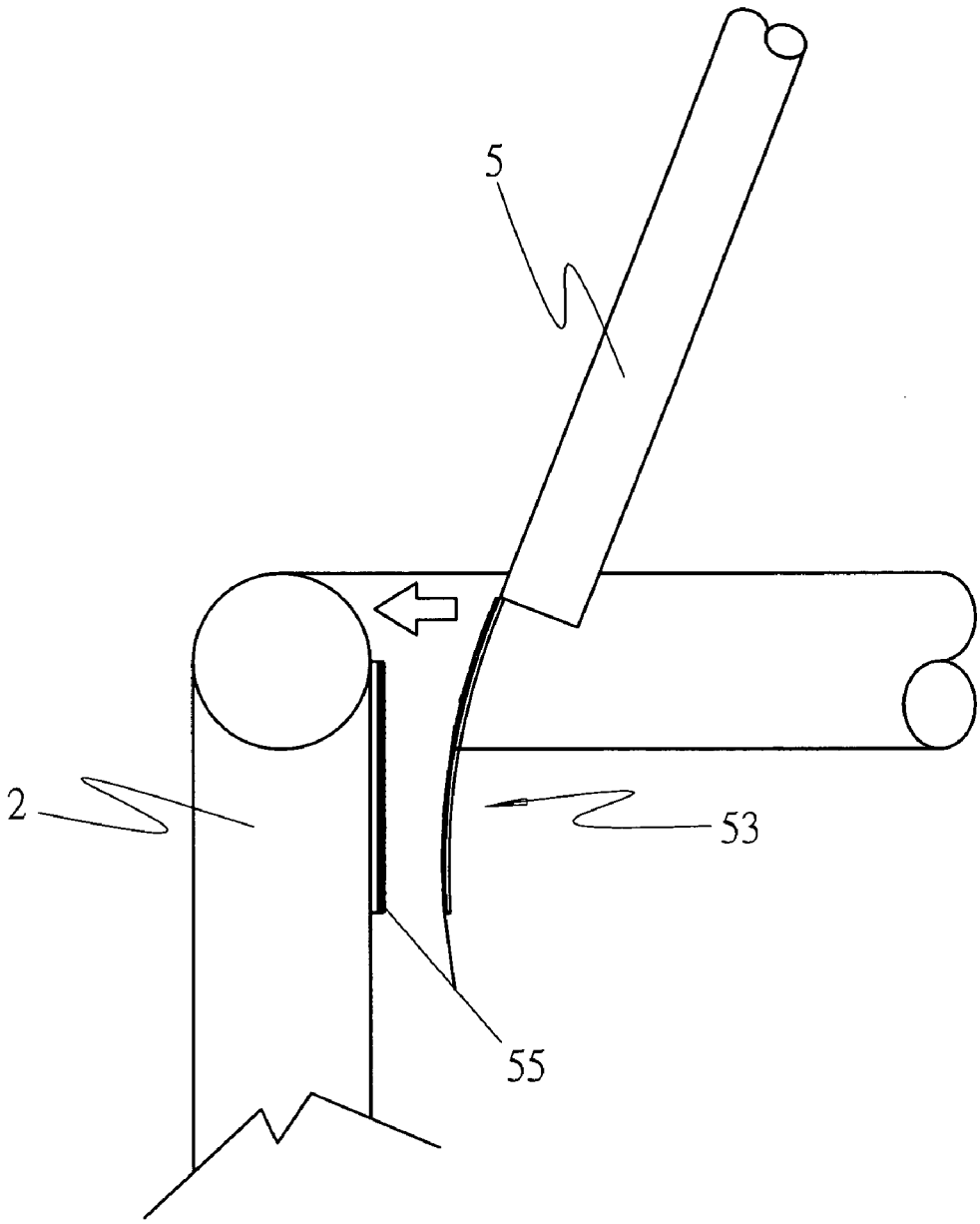
FIG. 7 is a schematic view of another embodiment of the connection section of the invention, being a Velcro™ tape, hook and loop fastener.
Figure 8:
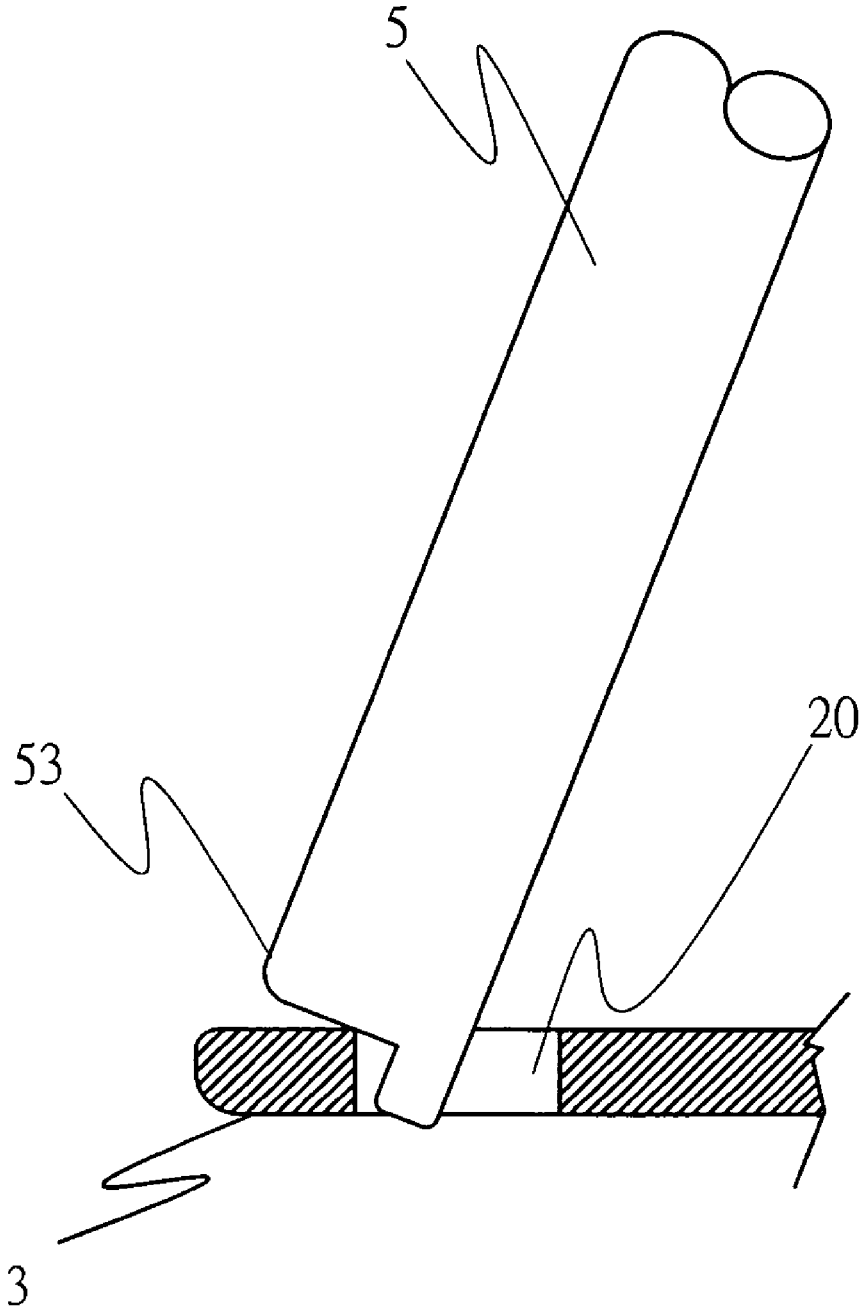
FIG. 8 is a schematic view of yet another embodiment of the connection section of the invention, engaging with an anchor bore.

The connection rod 5 has another end forming a connection section 53 to couple with the playpen 2 or the play pad 3. In this embodiment the connection section 53 is a clip 54 (referring to FIG. 6) coupling with the playpen 2 or the play pad 3. The connection section 53 may also be a Velcro™ tape, hook and loop fastener, 55 to bond the playpen 2 or the play pad 3 (as shown in FIG. 7). Moreover, the connection section 53 is also directly inserted into an anchor bore 20 formed on the playpen 2 or the play pad 3 (as shown in FIG. 8).

When in use, pull the connection rod 5 to compress the elastic element 7 through the axle 6 so that the connection rod 5 is moved in the range of the slot 52 to escape the first anchor section 43 (extended condition) and turned and moved to the second anchor section 44 (folding condition). The connection section 53 of the connection rod 5 is connected to the playpen 2 or play pad 3 to become the toys bracing bracket 1 for hanging toys. For collapsing, execute the aforesaid operation in reverse and the toys bracing bracket 1 is folded. Thus by means of the invention, the toys bracing bracket may be extended and folded easily.

While the preferred embodiments of the invention have been set forth for the purpose of disclosure, modifications of the disclosed embodiments of the invention as well as other embodiments thereof may occur to those skilled in the art.

Accordingly, the appended claims are intended to cover all embodiments, which do not depart from the spirit and scope of the invention.

What is claimed is:

1. A toys bracing bracket mounted astride on a playpen or a play pad, comprising:

a central pivot dock which is a shell having a plurality of pivotal coupling troughs, a first anchor section and a second anchor section; and a plurality of connection rods each having a connection section on one end to couple astride on the playpen or the play pad, and another end pivotally coupled with the pivotal coupling trough on the first anchor section in a first condition or on the second anchor section in a second condition, the another end of the connection rods being slidable toward and away from as well as pivotable relative to the central pivot dock.

2. The toys bracing bracket of claim 1, wherein the connection rods are pivotally coupled on the central pivot dock in a radial fashion and detachable to couple with the playpen.

3. The toys bracing bracket of claim 1, wherein the connection rods are extended to form the first condition and folded to form the second condition.

4. The toys bracing bracket of claim 1, wherein the central pivot dock has an elastic element to provide a biasing force to keep the connection rods in the first condition or the second condition.

5. The toys bracing bracket of claim 1, wherein the connection rod has one end forming a pivotal coupling section which has a slot to hold an axle to pivotally couple with the central pivot dock so that the connection rod is movable in the range of the slot.

6. The toys bracing bracket of claim 1, wherein the central pivot dock has a hanging section.

7. The toys bracing bracket of claim 1, wherein the connection section of the connection rod is a clip.

8. The toys bracing bracket of claim 1, wherein the connection section of the connection rod is a hook and loop fastener.

9. The toys bracing bracket of claim 1, wherein the first anchor section is normal to the second anchor section.

10. The toys bracing bracket of claim 1, wherein the connection rods are flexible hollow tubes.

11. The toys bracing bracket of claim 4, wherein the elastic element urges the connection rods away from the central pivot dock.

12. The toys bracing bracket of claim 6, wherein the connection rods are moved to a folded position in the second condition, the hanging section being enclosed within the connection rods when the connection rods are in the folded position.

13. The toys bracing bracket of claim 12, wherein the hanging section receives toys which hang facing the playpen or play pad.

14. The toys bracing bracket of claim 1, wherein the central pivot dock is a one-level structure.

* * * * *